US005697428A

United States Patent [19]

Akachi

[11] Patent Number: 5,697,428

[45] Date of Patent: Dec. 16, 1997

[54] TUNNEL-PLATE TYPE HEAT PIPE

[75] Inventor: Hisateru Akachi, No. 6-5-603, Kamitsuruma 5-chome, Sagamihara City, Kanagawa Perfecture, Japan

[73] Assignees: Actronics Kabushiki Kaisha, Isehara; Hisateru Akachi, Sagamihara, both of Japan

[21] Appl. No.: 352,217

[22] Filed: Dec. 2, 1994

Related U.S. Application Data

[63] Continuation-in-part of Ser. No. 224,415, Apr. 8, 1994, abandoned.

[30] Foreign Application Priority Data

Aug. 24, 1993 [JP] Japan ..... 5-241918

[51] Int. Cl.[6] ..... F28D 15/00

[52] U.S. Cl. ..... 165/104.21; 165/104.14; 165/104.33; 361/700

[58] Field of Search ..... 165/170, 104.33, 165/104.21, 104.14, 104.26; 361/702, 700; 257/715

[56] References Cited

U.S. PATENT DOCUMENTS

| | | | |
|---|---|---|---|
| 1,808,617 | 6/1931 | Thompson | 165/170 |
| 3,971,435 | 7/1976 | Peck | 361/700 X |
| 4,155,402 | 5/1979 | Just | 165/104.33 X |
| 4,452,051 | 6/1984 | Berger et al. | 165/104.11 X |
| 4,567,505 | 1/1986 | Pease et al. | 165/104.33 X |
| 4,590,993 | 5/1986 | Kurzweg | 165/104.31 |
| 4,602,679 | 7/1986 | Edelstein et al. | 165/104.14 X |
| 4,706,740 | 11/1987 | Mahefkey | 165/104.14 |
| 4,712,158 | 12/1987 | Kikuchi et al. | 361/702 X |
| 4,727,454 | 2/1988 | Neidig et al. | 361/382 |
| 4,921,041 | 5/1990 | Akachi | 165/104.29 |
| 5,051,814 | 9/1991 | Paal | 165/104.33 X |
| 5,179,500 | 1/1993 | Koubek et al. | 165/104.14 X |
| 5,219,020 | 6/1993 | Akachi | 165/104.26 |

FOREIGN PATENT DOCUMENTS

| | | | |
|---|---|---|---|
| 0 413 498 | 2/1991 | European Pat. Off. . | |
| 33 29 325 | 3/1984 | Germany . | |
| 34 02 003 | 7/1985 | Germany . | |
| 7054352 | 3/1982 | Japan | 257/715 |
| 3192253 | 8/1988 | Japan | 257/715 |
| 3224244 | 9/1988 | Japan | 257/715 |
| 318493 | 12/1988 | Japan . | |
| 0222825 | 9/1989 | Japan | 165/104.14 |
| 1292847 | 11/1989 | Japan | 257/715 |
| 190090 | 7/1992 | Japan . | |
| 251189 | 9/1992 | Japan . | |
| 1 388 937 | 3/1975 | United Kingdom . | |
| 2 226 125 | 6/1990 | United Kingdom . | |
| 2 250 087 | 5/1992 | United Kingdom . | |

OTHER PUBLICATIONS

Patent Abstracts of Japan, E1174, Mar. 5, 1992, vol. 16, and JP-A-3-273669, published Dec. 4, 1991.

Figures showing X-ray photos (corresponding description in English) of plate heat pipes manufactured by Actronics Co., Ltd., published by Actronics Co., Ltd., Tokyo, Mar. 1994.

Meeting Papers From The 71st JSME Spring Annual Meeting (From Mar. 29-Mar. 31), No. 940-10, Tokyo, Mar. 1994.

*Bulletin Of Japan Heat Pipe Society*, pp. 16-25, Tokyo, Sep. 1994.

Topics of Aircraft Thermal Management, Published by Air Force Wright Aeronautical Lab, Wright-Patterson Air Force Base, OH (citing "Heat-Transfer Microstructures for Integrated Circuits", D.B. Tuckerman, *VCRL-53515*, pp. 4 and 7, Feb. 1984).

*Primary Examiner*—John Rivell
*Assistant Examiner*—Christopher Atkinson
*Attorney, Agent, or Firm*—Foley & Lardner

[57] ABSTRACT

A heat pipe comprises an unit plate having one side formed with a groove which includes a plurality of straight portions arranged in parallel with each other and a plurality of turnings, and a flat plate disposed on the one side of the unit plate.

25 Claims, 6 Drawing Sheets

TUNNEL-PLATE TYPE HEAT PIPE

This application is a continuation-in-part of application Ser. No. 08/224,425, filed Apr. 8 1994, abandoned.

BACKGROUND OF THE INVENTION

The present invention relates generally to a plate-type heat pipe and more particularly, to a tunnel-plate type heat pipe.

Various kinds of plate-type heat plates have been proposed in past years. One of such plate-type heat pipes is of the snaky small-diameter tube type having a snaky small-diameter tube held by two plates. Referring to FIGS. 10 and 11, a snaky small-diameter tube 8 is held by two metal plates 3-3, 3-4, and fixed airtightly by a filler or solder 10. The snaky small-diameter tube 8 may be looped as shown in FIG. 11, or may not be looped. A spacer 9 is arranged to prevent the solder 10 from flowing out upon soldering. The snaky small-diameter tube 8 is very fine, i.e., 2 mm in outer diameter and 1.2 mm in inner diameter, having a great pressure proof strength. When made of pure copper and aluminum, the snaky small-diameter tube 8 has a strength to easily be resistible to an internal pressure of 100 $Kg/cm^2$ or more, contributing to a possible reduction in thickness of the heat plate.

There are three plate-type heat pipes with a snaky small-diameter tube:

I) Plate-type heat pipe with a looped small-diameter tube having a plurality of check valves arranged (see, for example, JP-A 63-318493), II) Plate-type heat pipe with a looped small-diameter tube without any check valve (see, for example, JP-A 4-190090), and III) Micro heat pipe (see, for example, JP-A 4-251189).

The above three plate-type heat pipes are advantageous to present a characteristic to actively operate in any application position.

However, such known plate-type heat pipes have the following inconveniences:

1) Improvement of the performance without increasing the thickness. Experiment reveals that the performance of the snaky small-diameter tube type heat pipe is improved with an increase in the number of turnings of the tube in the same plane, and that 30 turnings or more of the tube in a 100 mm width are needed for good operation in the top heat mode without great performance difference from the bottom heat mode.

However, it is known that a radius of curvature of the snaky small-diameter tube has a minimum limit. By way of example, with a pure copper tube, the minimum limit is in the order of 3.0 times as large as the diameter of the tube. If the radius of curvature of the tube is reduced below that limit, the tube is folded and not curved. By way of example, in order to put a 3 mm outer diameter tube in a 100 mm width, the tube should be arranged at a 9 mm pitch, and thus the maximum number of turnings of the tube is in the order of 11. It is understood that for excellent performance regardless of the application position, the heat plate should include three snaky small-diameter tubes.

This means that a minimum limit of the thickness of the heat plate is in the order of 13 mm, and that the performance is sacrificed when constructing a thinner heat plate.

2) Reduction in size and weight. It is necessary to take measures for a further reduction in size and weight of the heat plate in considering the size and weight of the snaky small-diameter tube itself.

3) Reduction in contact heat resistance. For a further improvement of the performance, it is desirable to decrease a contact heat resistance between the snaky small-diameter tube and the holding metal plates. The snaky small-diameter tube contacts the metal plates in a linear way or a broken-line way. The filler or solder for the reduction in contact heat resistance causes an increase in weight of the heat plate and a lowering of the heat response performance thereof.

4) Cost reduction by mechanization and automation. Bending a small-diameter tube to have a small radius of curvature and a plurality of turnings, and currently arranging the plurality of turnings of the tube between the metal plates for soldering is not easy work to carry out. This process necessitates a difficult manual work in a high temperature environment. Thus, it is difficult to mass produce the plate-type heat pipe with resulting in a unavoidable cost increase. Due to these difficulties the plate-type heat pipe is not generally developed except for special usage. Therefore, cost reduction by mechanization and automation of the work of manufacturing the plate-type heat pipe becomes urgent and pressing.

It is, therefore, an object of the present invention to provide a plate-type heat pipe which contributes to an improvement of the performance without any increase in size and weight, and manufacturing cost.

SUMMARY OF THE INVENTION

According to the present invention, there is provided a heat pipe, comprising:

a first plate, said first plate having one side formed with a groove, said groove having a plurality of straight portions arranged in parallel with each other and a plurality of turnings; and a second plate disposed on said one side of said first plate, wherein when closed by said second plate, said groove of said first plate serves as a tunnel to be charged with a predetermined amount of a predetermined working fluid.

DETAILED DESCRIPTION OF THE INVENTION

Referring to FIGS. 1–9, preferred embodiments of a plate-type heat pipe according to the present invention will be described.

Referring first to FIGS. 1–6, there is shown a first preferred embodiment of the present invention. A plate-type heat pipe 6 includes generally an unit plate 1-1 and a flat plate 3 disposed thereon, or two unit plates 1-1, 1-2 placed one upon another, which are made of a metal with excellent heat conductivity such as copper, aluminum or the like, and welded together. The unit plate 1-1 has a side formed with a long snaky groove 2 having a section substantially in a semicircle with a small diameter, and serving as a snaky tunnel 4 with a small diameter when closed by the flat plate 3 or another unit plate 1-2. When soldering the unit plate 1-1 and the unit plate 1-2 or the flat plate 3 together, meniscus of molten metal is formed at corners of the snaky tunnel 4. Thus, after solidifying of molten metal, the corners of the snaky tunnel 4 are closed in a curved way, so that a section of the snaky tunnel 4 changes from substantially a semicircle to substantially a circle which contributes to improvement of the efficiency of circulation and axial vibration of a working fluid during operation of the heat pipe 6. An inner diameter of the snaky tunnel 4 as calculated in terms of a circle is limited to be smaller than 3 mm, which is a value ensuring efficient operation of the heat pipe with a snaky small-diameter tube. The long snaky groove 2 is obtained by cutting, numeral, control machining, electrolytic etching, press forming etc. When charging the snaky tunnel 4 with a predetermined working fluid by a predetermined amount, the heat pipe 6 fulfills its function. The working fluid has a liquid state and a vapor state which alternate in the longitudinal direction of the snaky tunnel 4. The function of a heat pipe with this type of working fluid, but having a snaky small-diameter tube instead of a snaky tunnel is discussed in U.S. Pat. No. 5,219,020, issued Jun. 15, 1993, to Akachi, which is herein incorporated by reference.

Figure 1:
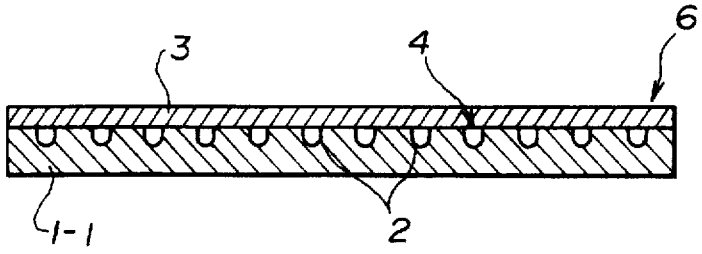
FIG. 1 is a cross section showing one example of a first preferred embodiment of a plate-type heat pipe according to the present invention.

Referring to FIG. 1, the heat pipe 6 is formed by one unit plate 1-1 and one flat plate 3. The flat plate 3 is disposed on the unit plate 1-1 on a side thereof with the long snaky groove 2 to obtain the snaky tunnel 4.

Figure 2:
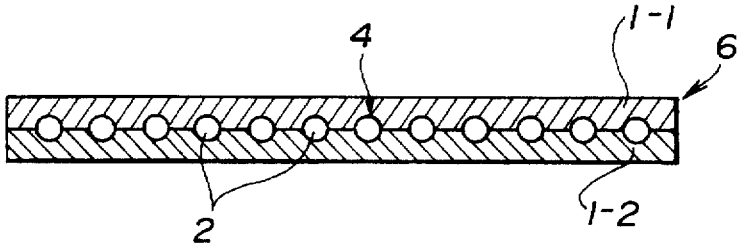
FIG. 2 is a view similar to FIG. 1, showing another example of the first embodiment of the plate-type heat plate.

Referring to FIG. 2, the heat pipe 6 is formed by two unit plates 1-1, 1-2 without using the flat plate 3. Sides of the unit plates 1-1, 1-2 with the long snaky groove 2 are faced each other to obtain the snaky tunnel 4. In this case, the snaky tunnel 4 has a section substantially in a circle, which contributes to a reduction in resistance in connection with circulation and vibration of the working fluid.

Figure 3:
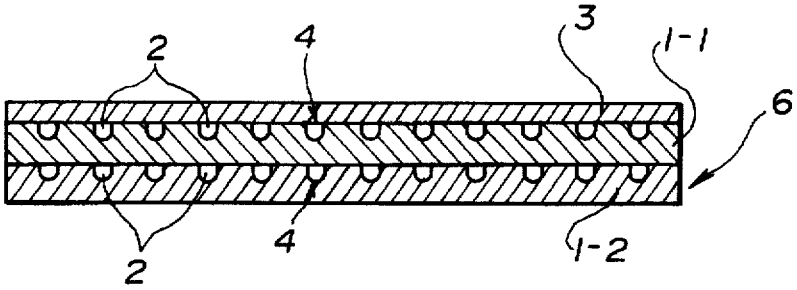
FIG. 3 is a view similar to FIG. 2, showing a still another example of the first embodiment of the plate-type heat plate.

Referring to FIG. 3, the heat pipe 6 is formed by two unit plates 1-1, 1-2 and one flat plate 3. The two unit plates 1-1, 1-2 are placed one upon another so that sides of the unit plates 1-1, 1-2 with the long snaky groove 2 are not faced each other. In a similar way to the heat pipe 6 as shown in FIG. 1, the flat plate 3 is disposed on the unit plate 1-1, thus obtaining the heat pipe 6 of the two-tunnel type having upper and lower snaky tunnels 4 as shown in FIG. 3.

Figure 4:
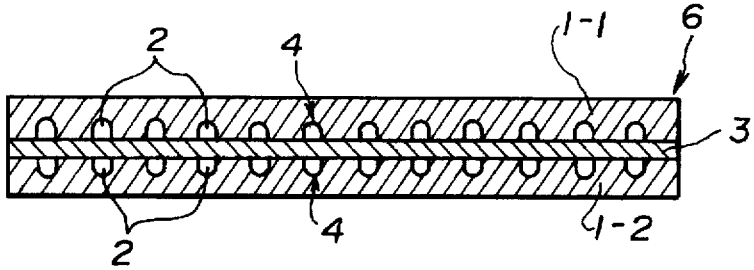
FIG. 4 is a view similar to FIG. 3, showing a further example of the first embodiment of the plate-type heat plate.
Figure 8:
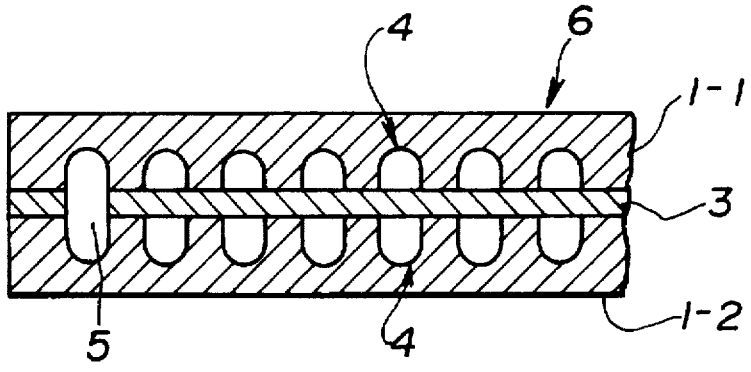
FIG. 8 is a fragmentary cross section showing a third preferred embodiment of the plate-type heat pipe.

Referring to FIG. 4, in a similar way to the heat pipe as shown in FIG. 8, the heat pipe 6 is formed by two unit plates 1-1, 1-2 and one flat plate 3. However, sides of the unit plates 1-1, 1-2 with the long snaky groove 2 are faced each other to hold the flat plate 3 therebetween. Thus, the snaky tunnels 4 are symmetrically arranged with respect to the flat plate 3.

Figure 5:
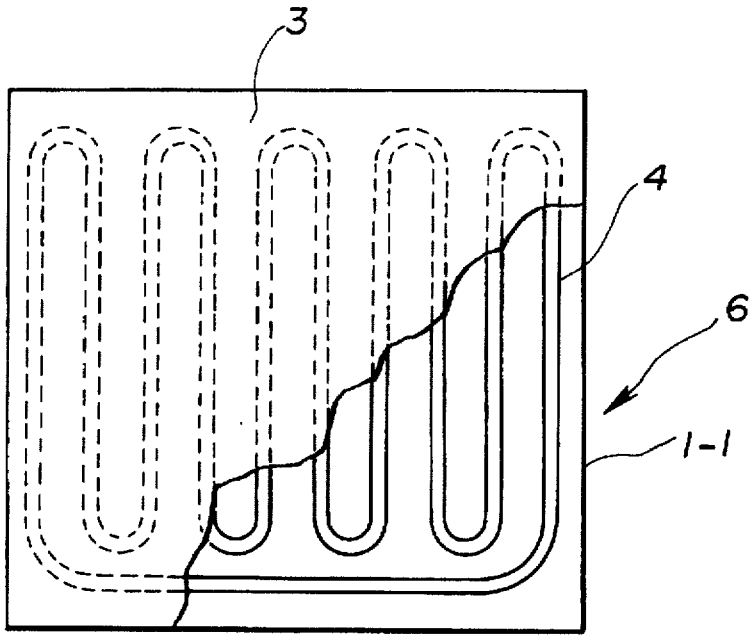
FIG. 5 is a partly cutaway plan view showing the looped type heat pipe.
Figure 6:
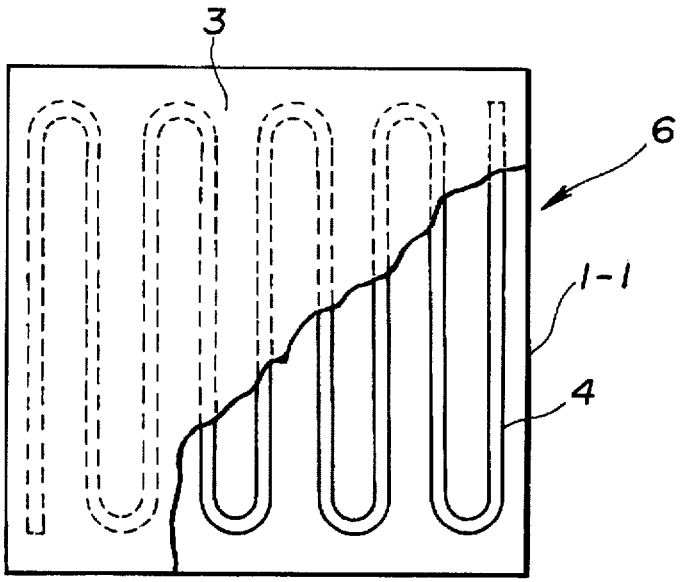
FIG. 6 is a view similar to FIG. 5, showing the non-looped type heat pipe.

FIGS. 5 and 6 are plan views showing the heat pipe 6, respectively. The snaky tunnel 4 may be looped as shown in FIG. 5 to obtain the heat pipe 6 of the looped type, or may not be looped as shown in FIG. 6 to obtain the heat pipe 6 of the non-looped type.

Figure 7:
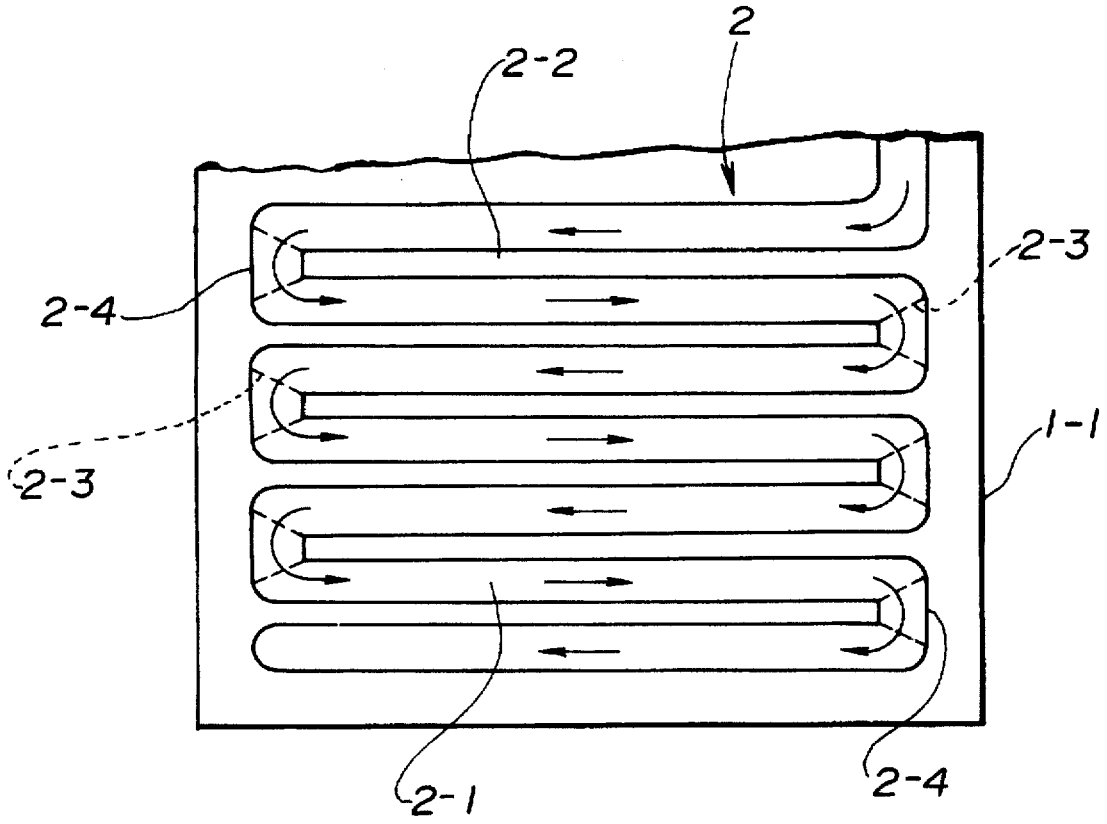
FIG. 7 is a fragmentary plan view showing a second embodiment of the plate-type heat pipe.

Referring to FIG. 7, there is shown a second preferred embodiment of the present invention. In this embodiment, the plate-type heat pipe has a snaky small groove 2 densely arranged on a side of the unit plate 1-1.

Specifically, the side of the unit plate 1-1 facing the flat plate (not shown) is formed with the snaky small groove 2 with a predetermined depth and a predetermined width, which has a plurality of turned portions 2-1 arranged in parallel and adjacent to each other. Two adjacent turned portions 2-1 having a turning 2-4 are arranged to make a pair, ends of each extending up to the same positions on the unit plate 1-1. A crest 2-2 formed between the paired turned portions 2-1 is shortened by a predetermined length at an end of each of the paired turned portions 2-1, thus forming a crest lacked portion 2-3 which allows fluid communication between the paired turned portions 2-1 as indicated by arrows in FIG. 7. It is understood that the crest lacked portion 2-3 corresponds to the turning 2-4. Thus, the heat pipe is constructed to have the snaky small groove 2 with a plurality of turnings 2-4.

In this embodiment, the snaky small groove 2 can include the plurality of turned portions 2-1 at intervals of the width of the crest 2-2, resulting in possible arrangement of the maximum number of turned portions 2-1. Therefore, the heat pipe according to the present invention can include the turnings of the snaky tunnel several times as many as that of the snaky small-diameter tube of the known heat pipe. It is to be understood that the correlation between the number of snaky turnings 4 and the performance of the heat pipe of the present invention is the same as in a micro-heat pipe as disclosed in U.S. Pat. No. 5,219,020, which has already been incorporated by reference. Experiments revealed the following facts. The heat pipe of the present invention having the snaky tunnel with 2 turnings shows excellent performance in the bottom heat mode (the different modes of heating are discussed in U.S. Pat. No. 5,219,020) when the level of a heat receiving portion is held lower than that of a heat radiating portion. The heat pipe fails to operate when the level of the heat receiving portion is held equal to that of the heat radiating portion in the horizontal heat mode, and when the level of the heat receiving portion is held higher than that of the heat radiating portion in the top heating mode.

A heat pipe having a snaky tunnel with 10 turnings shows excellent performance both in the bottom and horizontal heat modes, but fails to operate in the top heat mode. A heat pipe having the snaky tunnel with 20 turnings shows excellent performance in any of the modes. However, the performance in each mode is largely different from each other. For example, the heat pipe works best in the bottom heat mode, while being inferior in the top heat mode.

A heat pipe having the snaky tunnel with 40 turnings shows excellent performance in all of the modes and with practically no occurrence of the difference of the performance between the modes. Moreover, experiments have revealed that an increase in the number of turnings contributes to a great improvement of the heat transfer capacity of the heat plate, which exceeds the increase rates of the number of turnings and the overall length of the small groove. This experiment used the heat plate of 500 mm×500 mm, having the snaky tunnel of 2 mm inner diameter as calculated in terms of a circle and the working fluid charged in the small tunnel by 50% internal volume thereof. The same result is also obtained with different heat plates having a smaller size than 500 mm×500 mm, which were put to practical use subsequently. In such a way, if the heat pipe has a snaky continuous tunnel, the performance thereof is improved with an increase in the number of turnings, which exceeds the increase rate thereof.

Referring to FIG. 8, there is shown a third preferred embodiment of the present invention. This embodiment is similar to the first preferred embodiment as shown in FIG. 4 except that a through hole 5 is arranged to allow fluid communication between two snaky tunnels 4 of the unit plates 1-1, 1-2.

Specifically, the plate-type heat pipe 6 is formed by two unit plates 1-1, 1-2 and one flat plate 3 interposed therebetween. The through hole 5 is arranged through the flat plate 3 to allow fluid communication between the snaky tunnels 4 of the unit plates 1-1, 1-2. Since the working fluid within the snaky tunnels 4 of the unit plates 1-1, 1-2 is movable by the through hole 5 arranged through the flat plate 3, the heat pipe 6 can obtain further increased number of turns of the snaky tunnel resulting in improvement of the performance of the heat pipe.

In a similar way to the known heat pipe with a snaky small-diameter tube, the performance of the heat pipe 6 with the snaky tunnel 4 is improved in proportion to the number of turnings of the snaky tunnel 4. When the number of turnings of the snaky tunnel 4 exceeds a predetermined value, the high performance is always obtained regardless of the application position or mode. Therefore, according to this embodiment, since the snaky tunnels 4 of the adjacent unit plates 1-1, 1-2 are fluidly connected to each other by the through hole 5, the heat pipe 6 has further improved performance as compared with the heat pipe having independent snaky tunnels. Moreover, the heat pipe produces the same performance on two sides thereof, resulting in the advantage of having no temperature difference between the two sides.

This embodiment is not limited to the heat plate construction as shown in FIG. 8, but applicable to any heat plate construction in which the adjacent snaky tunnels 4 can be fluidly connected to each other by the through hole 5 arranged through a partition wall such as the flat plate 3, e.g., the heat plate construction having a plurality of heat plates placed one upon another, each being as shown in FIG. 2, and the heat plate construction having a plurality of unit plates placed one upon another. Moreover, this embodiment is applicable not only to the looped heat plate as shown in FIG. 5, but to the non-looped heat pipe as shown in FIG. 6.

Figure 9:
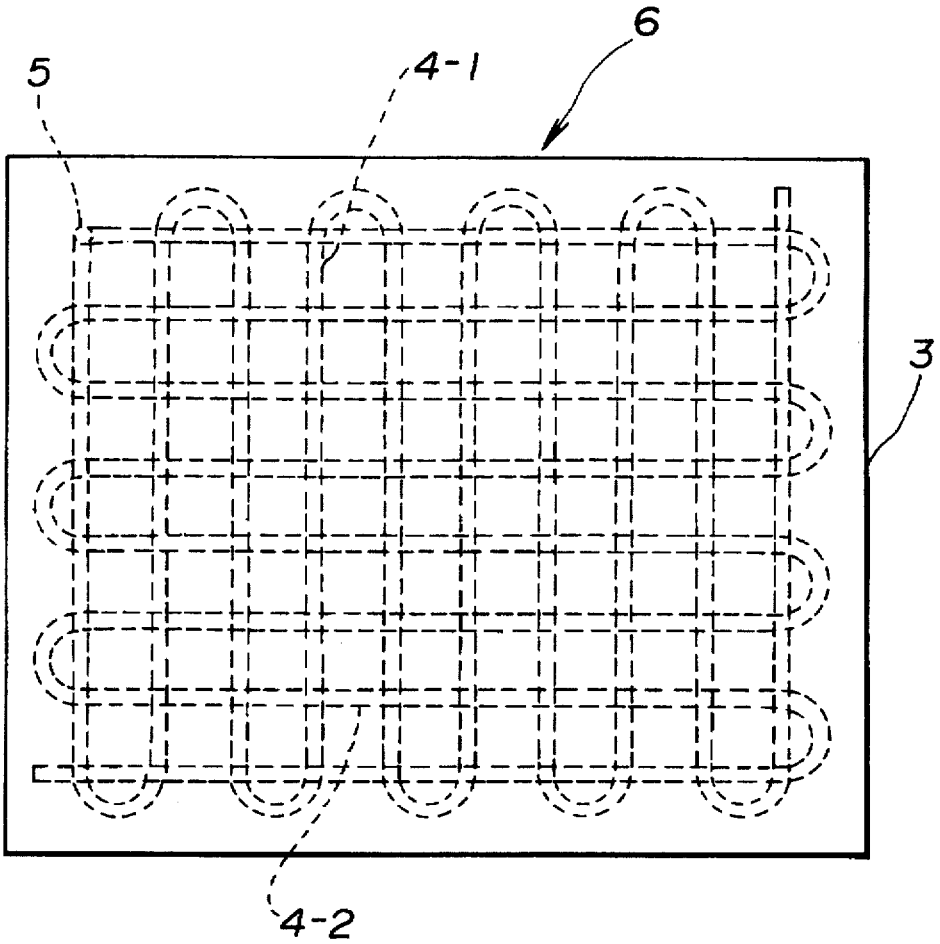
FIG. 9 is a plan view showing a fourth preferred embodiment of the plate-type heat pipe.
Figure 10:
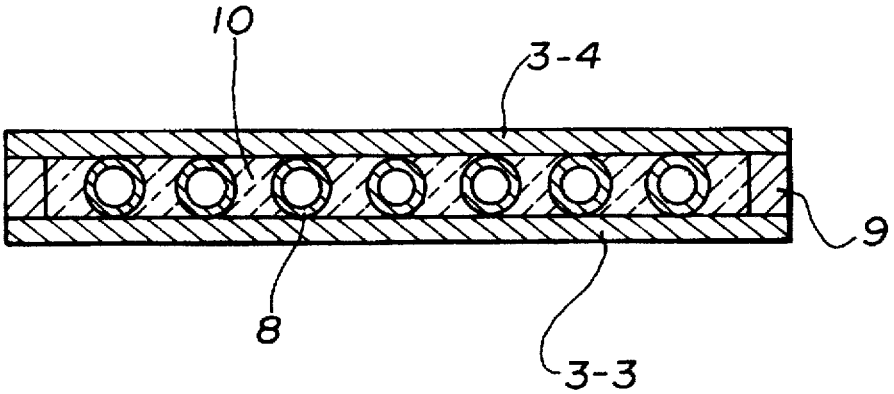
FIG.10(PRIOR ART)
FIG. 10 is a view similar to FIG. 4, showing a known plate-type heat pipe.
Figure 11:
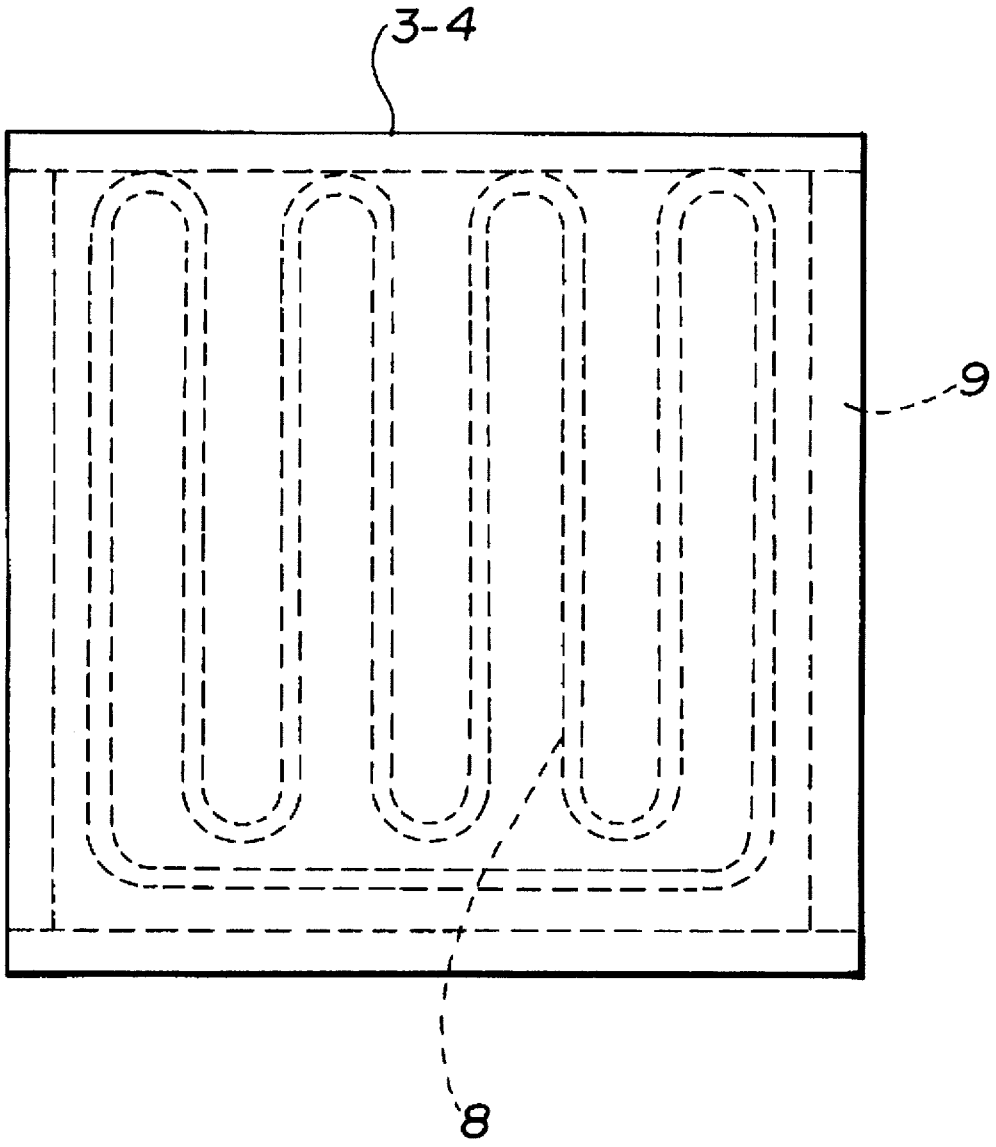
FIG.11 (PRIOR ART)
FIG. 11 is a view similar to FIG. 9, showing the known plate-type heat pipe.

Referring to FIG. 9, there is shown a fourth preferred embodiment of the present invention. In this embodiment, the plate-type heat pipe 6 includes a plurality of snaky tunnels, two adjacent snaky tunnels 4-1, 4-2 having straight interconnecting portions arranged to cross each other at right angles. In a similar way to the third preferred embodiment, the through hole 5 is arranged through a partition wall such as the unit plate to allow fluid communication between the snaky tunnels 4-1, 4-2.

In a similar way to heat transfer in the heat pipe with a snaky small-diameter tube, heat transfer in the heat pipe 6 with a snaky tunnel is carried out by circulation or axial vibration of the working fluid, and thus takes place only in the longitudinal direction of the snaky tunnel. Therefore, the snaky tunnel has very insufficient heat transfer capacity in the direction to cross at right angles the longitudinal direction of the snaky tunnel. As a result, the heat pipe has a great temperature gradient in the former direction.

According to this embodiment, since the straight interconnecting portions of the adjacent snaky tunnels are arranged to cross each other at right angles, the adjacent snaky tunnels ensures compensation of heat transfer capacity with each other, obtaining uniform heat transfer capacity in all the directions of the heat pipe. Experiment reveals that even when applying any amount of heat to the above heat pipe at any position thereon, all its surface is heated at the same temperature with very small temperature irregularity. If the heat pipe is constructed so that the adjacent snaky tunnels 4-1, 4-2 are connected to each other by the through hole 5 as shown in FIG. 9, a more uniform temperature is obtained on the surface of the heat pipe with uniform temperature difference between the adjacent unit plates.

Figure 12:
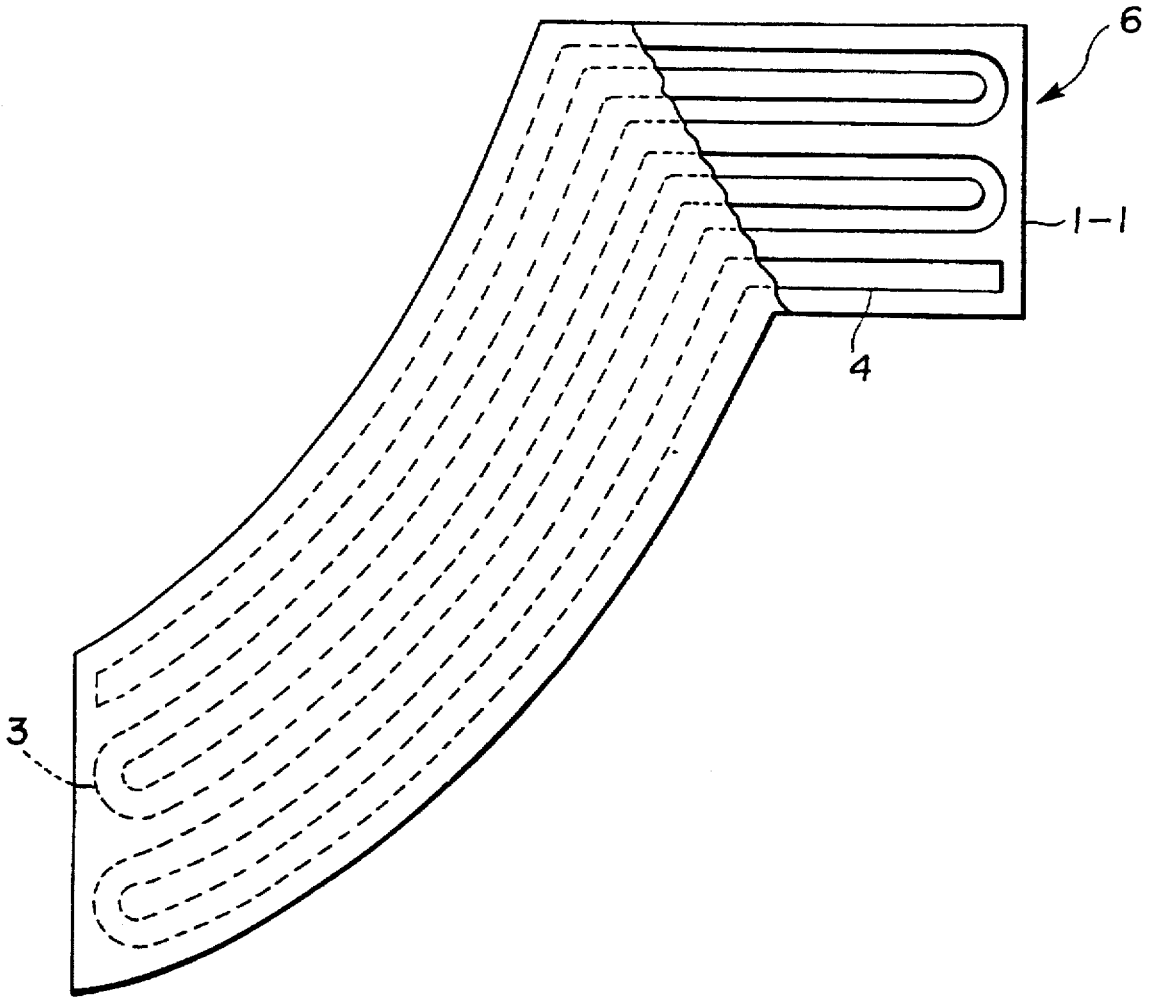
FIG. 12 is a plan view showing a fifth preferred embodiment of plate-type heat pipe.

FIG. 12 shows an alternative embodiment of the heat plate 6, wherein the interconnecting portions between the adjacent snaky tunnel are formed in a curved or polygonal line.

Due to a tunnel construction arranged between the plates, the plate-type heat pipe according to the present invention can include in the same sectional area the turnings of the snaky tunnel several times as many as those of the snaky small-diameter tube of the known heat pipe, enabling a great reduction in thickness and heat resistance as compared with the known heat pipe, resulting in not only a possible reduction in size and weight, but a possible improvement of the performance.

The plate-type heat pipe according to the present invention has a widely enlarged applicability. Examples of application are as follows: A) Cold plates for a large-sized computer, printed boards, heating elements, or heat transfer ribbons for densely mounted parts; B) Thermal diffusion plates for powerful, small-sized and difficult-heat-radiation heat elements; C) Heat treatment plates; D) Detachable heat connection ribbons; E) Removable cold plates, etc.

Moreover, the plate-type heat pipe according to the present invention contributes to a great cost reduction as compared with the known plate-type heat pipe. This is due to a stage of work having only two processes which are easy to adapt to a mass production and automation.

Having described the present invention in connection with the preferred embodiments, it is to be noted that the present invention is not limited thereto, and various changes and modifications are possible without departing from the spirit of the present invention.

What is claimed is:

1. A heat pipe, comprising:

at least one first plate, said at least one first plate being metal and having one side formed with a continuous groove, said groove having a substantially semicircular cross-section throughout said groove, said groove forming a continuous channel in said at least one first plate, said channel having a predetermined number of turnings and a predetermined number of portions arranged in parallel with each other, each portion interconnecting corresponding ends of adjacent turnings of said predetermined number of turnings; and a second plate disposed on said one side of said at least one first plate, wherein said second plate closes said channel such that said groove of said first plate serves as a tunnel to be charged with a predetermined amount of a working fluid; and wherein said second plate is free of a through-hole that allows communication between said tunnel and an exterior of the heat pipe.

2. A heat pipe as claimed in claim 1, wherein said second plate includes a flat plate.

3. A heat pipe as claimed in claim 1, wherein said second plate has one side formed with a groove which corresponds to said groove of said at least one first plate and another side.

4. A heat pipe as claimed in claim 3, wherein said one side of said second plate is disposed to face said one side of said at least one first plate.

5. A heat pipe as claimed in claim 3, wherein said another side of said second plate is disposed to face said one side of said at least one first plate.

6. A heat pipe as claimed in claim 1, wherein said at least one first plate and said second plate are made of a metal with excellent heat conductivity.

7. A heat pipe as claimed in claim 6, wherein said metal includes copper and aluminum.

8. A heat pipe as claimed in claim 1, wherein said groove of said at least one first plate has a predetermined depth, a predetermined width, and a predetermined pitch.

9. A heat pipe as claimed in claim 8, wherein said groove of said at least one first plate is formed in a closed loop.

10. A heat pipe as claimed in claim 8, wherein said groove of said at least one first plate is formed in an open loop.

11. A heat pipe as claimed in claim 1, wherein said predetermined number of portions of said at least one first plate have ends extending up to the same positions on said at least one first plate.

12. A heat pipe as claimed in claim 1, wherein said first plate is formed with a through hole communicating with said groove of said first plate.

13. A heat pipe as claimed in claim 1, wherein said second plate is formed with a through hole communicating with said groove of said at least one first plate.

14. A heat pipe, comprising:

at least one first plate, said at least one first plate being metal and having one side formed with a continuous groove, said groove having a cross-section substantially in a semicircle, said groove forming a continuous channel in said at least one first plate, said channel having a predetermined number of turnings and a predetermined number of portions arranged in parallel with each other, each portion interconnecting corresponding ends of adjacent two of said predetermined number of turnings;

means for sealing said channel of said at least one first plate, when closed by said sealing means, said groove of said at least one first plate serving as a tunnel; and a predetermined amount of a working fluid contained in said tunnel, said working fluid having a liquid state and a vapor state which are alternately found in a longitudinal direction of said tunnel in an operating condition of the heat pipe, wherein heat transfer is carried out at least by vibration of said predetermined amount of said working fluid in said longitudinal direction of said tunnel; and wherein said sealing means closes said channel so that said tunnel is free from communication with an exterior of the heat pipe.

15. A heat pipe as claimed in claim 14, wherein said at least one first plate comprises two plates; and wherein said sealing means include a side of one of said two plates.

16. A heat pipe as claimed in claim 14, wherein said sealing means include one side of a flat plate.

17. A heat pipe as claimed in claim 16, wherein said sealing means include another side of said flat plate.

18. A heat pipe as claimed in claim 1, wherein said tunnel has an inner diameter as calculated in terms of a circle being smaller than 3 mm.

19. A heat pipe as claimed in claim 1, wherein said portions of said groove are in the form of at least one of a straight line, a curved line, and a polygonal line.

20. A heat pipe as claimed in claim 1, wherein said predetermined number of turnings of said groove is greater than 20.

21. A heat pipe as claimed in claim 20, wherein said predetermined number of turnings of said groove is greater than 40.

22. A heat pipe, comprising:

at least one first plate, said at least one first plate being metal and having one side formed with a continuous groove, said groove having a cross-section substantially in a semicircle, said groove forming a continuous channel in said at least one first plate, said channel having a predetermined number of turnings and a predetermined number of portions arranged in parallel with each other, each portion interconnecting corresponding ends of adjacent two of said predetermined number of turnings;

a second plate disposed on said one side of said at least one first plate, when closed by said second plate, said channel of said at least one first plate serving as a tunnel; and a predetermined amount of a working fluid contained in said tunnel, said working fluid having a liquid state and a vapor state which are alternately found in a longitudinal direction of said tunnel in an operating condition of the heat pipe, wherein heat transfer is carried out at least by vibration of said predetermined amount of said working fluid in said longitudinal direction of said tunnel; and wherein said second plate is free of a through-hole that allows communication between said tunnel and an extension of the heat pipe.

23. A heat pipe as claimed in claim 1, wherein said at least one first plate includes a unit plate and said second plate is a flat plate.

24. A heat pipe as claimed in claim 4, wherein flat plate is arranged between said second plate and said at least one first plate.

25. A heat pipe as claimed in claim 1, wherein a crest is formed between said portions, and wherein said second plate is a flat plate.

* * * * *